US005297979A

United States Patent [19]

Amron

[11] Patent Number: 5,297,979

[45] Date of Patent: Mar. 29, 1994

[54] BUBBLE MAKER

[76] Inventor: Alan B. Amron, 170 Berryhill Rd., Syosset, N.Y. 11797

[21] Appl. No.: 58,513

[22] Filed: May 3, 1993

[51] Int. Cl.[5] ..... A63H 33/28; B05B 17/00

[52] U.S. Cl. ..... 446/16; 446/475; 239/211; 239/289

[58] Field of Search ..... 446/15, 16, 475; 222/78, 130, 192; 239/211, 289

[56] References Cited

U.S. PATENT DOCUMENTS

| | | | |
|---|---|---|---|
| 3,246,418 | 4/1966 | Andersen et al. | 446/16 |
| 3,998,001 | 12/1976 | Meyer et al. | 446/479 X |
| 4,334,383 | 6/1982 | Melotti | 446/475 X |
| 5,234,129 | 9/1993 | Lau | 446/18 X |

FOREIGN PATENT DOCUMENTS

| | | | |
|---|---|---|---|
| 82233 | 6/1983 | European Pat. Off. | 446/16 |
| 2301305 | 10/1976 | France | 239/211 |

*Primary Examiner*—Danton D. DeMille
*Attorney, Agent, or Firm*—Gerard F. Dunne

[57] ABSTRACT

A device for producing bubbles from water pressure which may be used in connection with a sprinkler includes a turbine, and means for connecting a turbine to a source of pressurized water for rotating the turbine. Structures are provided which include a fan rotated by motive power from the turbine, and a container for a solution capable of forming bubbles is provided with a dipper having at least one opening positioned under motive power of the turbine to place the openings sequentially within the container and thereafter into the flow of air created by the fan.

4 Claims, 4 Drawing Sheets

BUBBLE MAKER

FIELD OF THE INVENTION

The present invention relates to a device which can form bubbles from water pressure that can be developed by simply attaching a garden hose to the device, and in a preferred from, the device is associated with a lawn sprinkler.

SUMMARY OF THE INVENTION

Lawn sprinklers and other devices are known for children to play outdoors, and it is an object of the present invention to provide a device which can make bubbles which may be used in conjunction with a lawn sprinkler to provide a outdoor toy of enhanced play value. Accordingly to the present invention, a turbine is adapted to be connected to a source of pressurized water for rotating the turbine, structures are provided for forming bubbles under the motive power of the rotating turbine. Preferably, the bubble-forming structures include a fan for forming a flow of air, and means for rotating this fan upon rotation of the turbine. A container for a solution capable of forming bubbles is provided, and a dipper having at least one opening is adapted to be positioned within the container and withdrawn into the flow of air created by the fan upon the motive power of the rotating turbine. In this way, the device can be connected to a source of pressurized water such as a typical garden hose, and bubbles can be created for play by children without the need for any other power source. In a preferred form of the present invention, a sprinkler which also receives its motive power from the pressurized water is provided so that a toy providing both a spray of water and a flow of bubbles can be provided.

These and other objects, advantages, and features of the present invention would be better understood in view of the descriptions below, made in connection with the following drawings.

Figure 1:
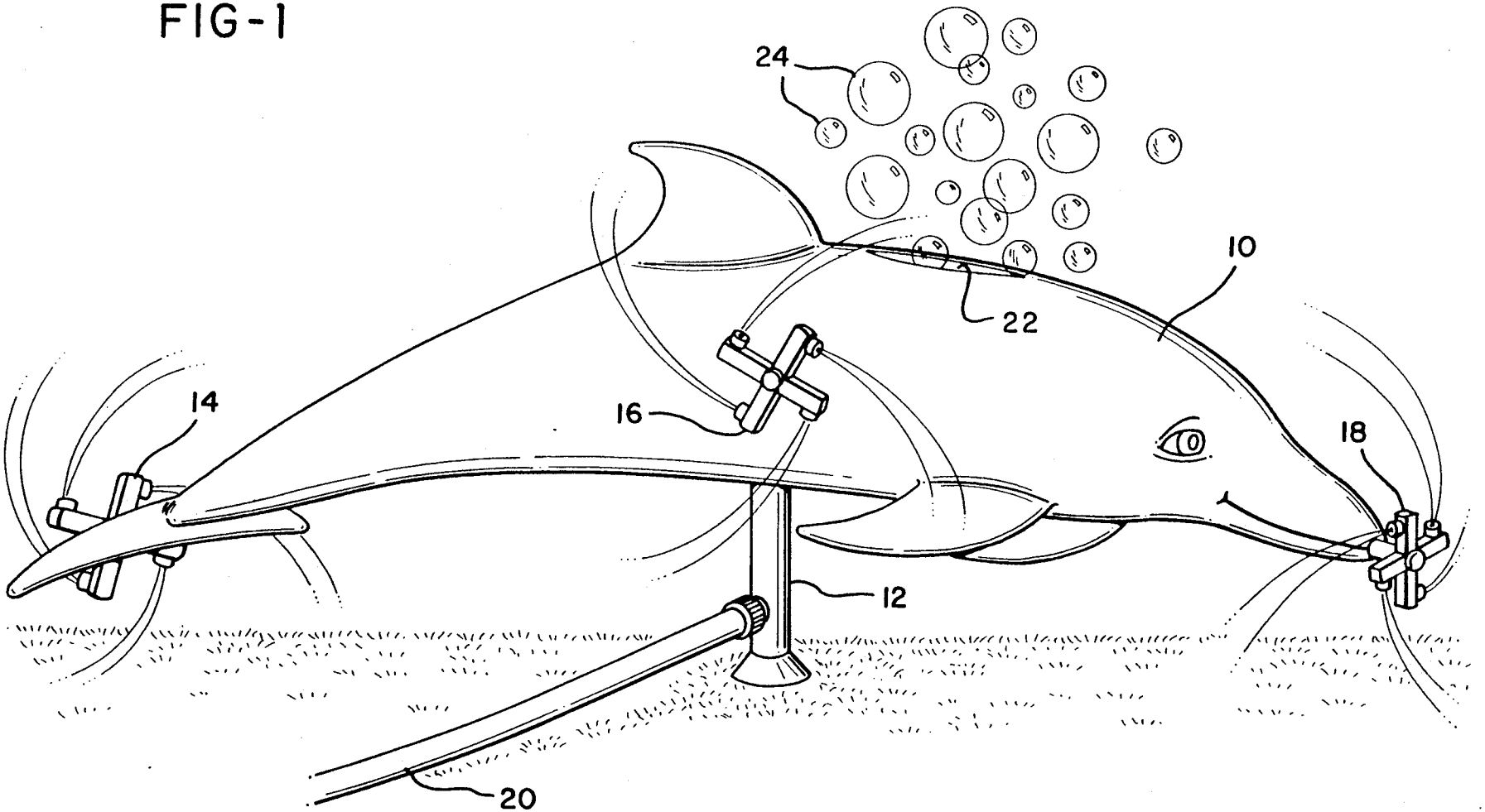
FIG. 1 illustrates an embodiment of the present invention.

FIG. 1 illustrates a device according to the present invention, and illustrates a housing 10 formed into the shape of an object or character that may be associated with a child's toy. In FIG. 1, the housing is formed into the shape of a dolphin; but it should be understood that the housing may take any form suitable for a child's toy. In FIG. 1, the housing 10 is mounted upon a stand 12 and includes a plurality of rotating sprinkler heads 14, 16 and 18 which may provide a spray of water when the device of the present invention is connected to a typical garden hose 20. Illustrated in the top of the housing 10 is an opening 22 for release of bubbles 24 created by a mechanism within the housing. In this way, a toy providing a spray of water much in the matter of a lawn sprinkler will be provided which will also provide a plurality of bubbles to enhance the play value for children.

Figure 2:
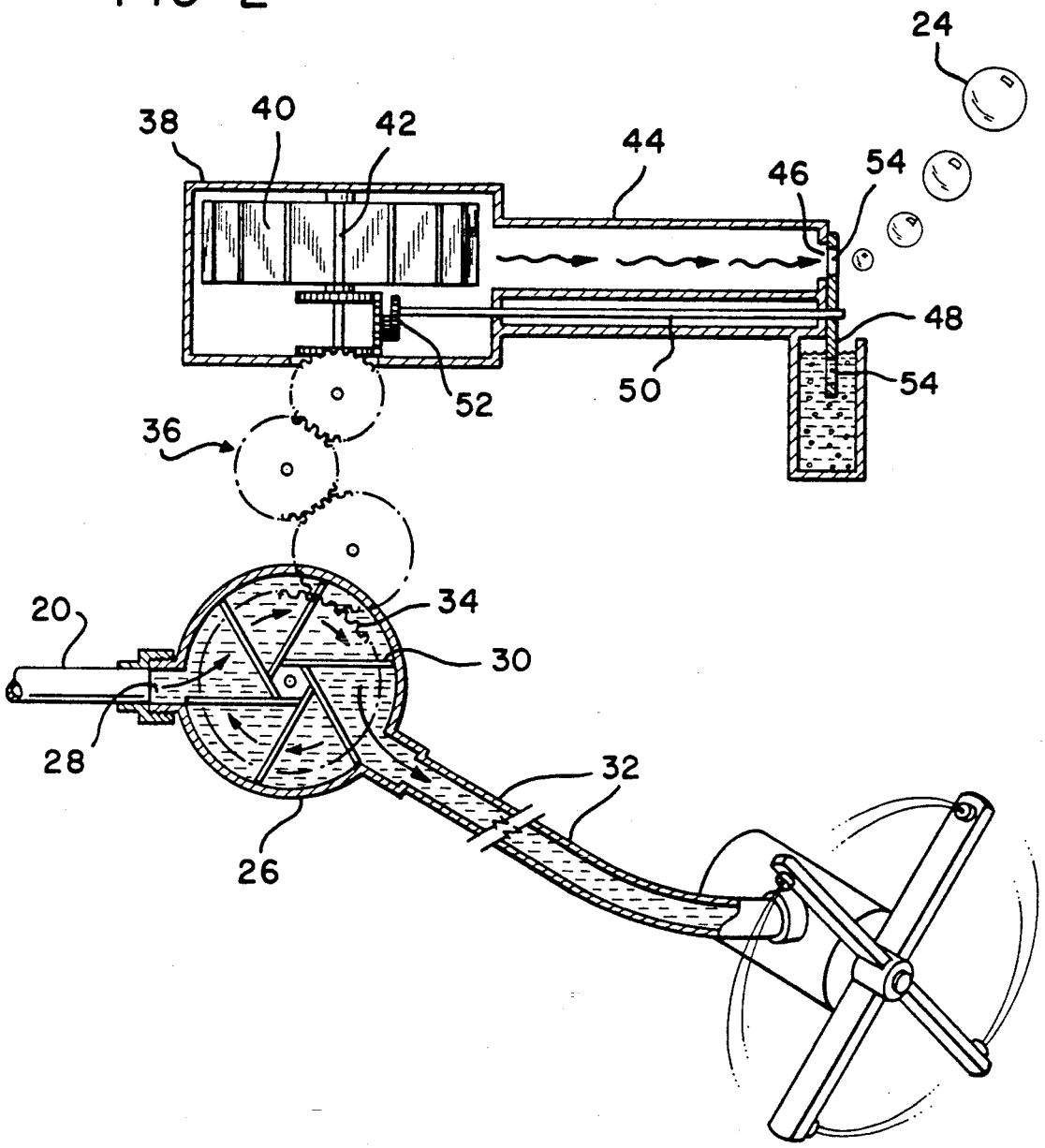
FIG. 2 illustrates schematically the operation of a device according to the present invention.

As illustrated in FIG. 2, the mechanism within the housing 10 could include a turbine 26 which receives water under pressure from the garden hose 20 through inlet conduit 28. As would be understood in the art, the water pressure received from the garden hose 20 would impinge upon blades 30 of the turbine to rotate the turbine. As illustrated schematically in FIG. 2, water exiting the turbine is directed to tubing 32 which may be connected to one or more sprinkler heads such as the heads 14, 16 or 18 illustrated in FIG. 1. As will be well understood in the art, the hose 32 can be bifurcated many times if more than one sprinkler head is desired.

Connected to the turbine 26 in the embodiment illustrated in FIG. 2 is a gear 34 which is connected through a gear train 36 to the box 38 for rotary fan 40. As shown in FIG. 2, the gear train 36 is connected to a plurality of gears connected to the axle 42 of the fan 40 so that the fan 40 will be rotated upon the motive power of the turbine 30.

In the embodiment illustrated in FIG. 2, the fan box 38 has a reduced-diameter extension 44 leading to its end having an opening 46 located centrally therewithin.

A dipper wheel 48 is mounted for rotation upon the extension 44 of the fan housing, and wheel 48 has an axle shaft 50 connected to gear 52 driven from the gear train 36. The wheel 48 has a plurality of openings 54 arranged circumferently, and depending from the extension 44 is a container 56 containing an appropriate solution for forming bubbles. As will be understood, rotation of the shaft 50 and the wheel 48 from the motive power of the turbine sequentially places openings 54 into the bubble solution within the container 56 and upon further rotation of the wheel 48, the openings 54 containing solution are sequentially brought into alignment with the open 46 so that a flow of air from the fan 40 through extension 44 will form a plurality of bubbles which can drift upwardly through the opening 22 in the housing 10.

Figure 3:
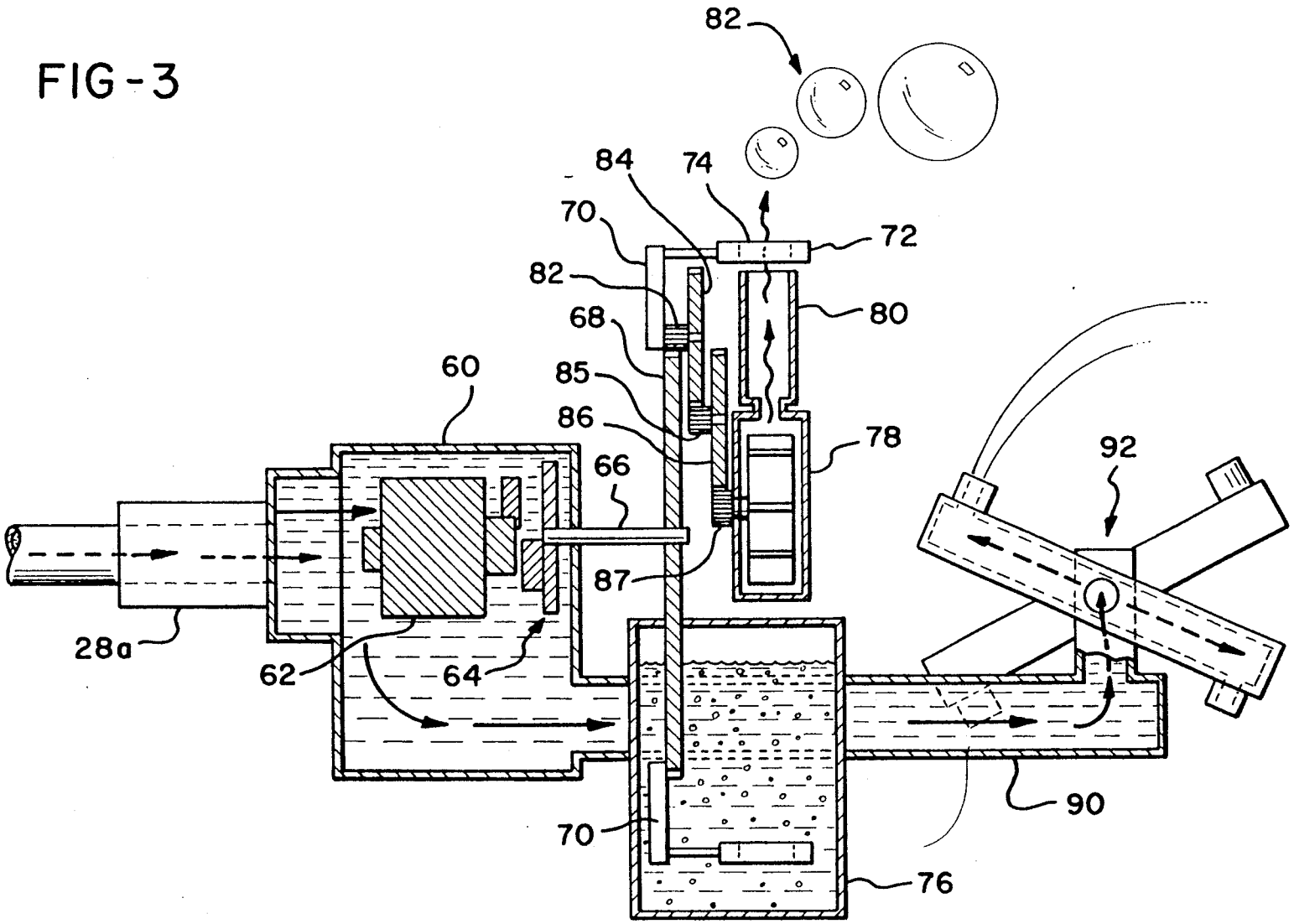
FIG. 3 illustrates schematically an alternate embodiment of the present invention.

In the embodiment illustrated in FIG. 3, a connection **28*a* is made for the source of pressurized water such as a garden hose, and the water is delivered into a turbine housing 60 containing rotary turbine 62 connected to gear train 64. Gear train 64 is connected directly to axle 66 of dipper wheel 68. Wheel 68 has a plurality of radial extensions 70 extending circumferently around the outer surface of the wheel, and each of these radial extensions 70 carries a bracket 72 having a central opening 74** therewithin.

A container 76 for a bubble solution is provided so that upon rotation of the wheel 68, the brackets 72 arranged circumferently around the wheel will be dipped into the container 76 so that bubble solution will extend across the opening 74. Upon further rotation of the wheel 68 to bring a bracket containing bubble solution into its uppermost position, a flow of air generated by a rotary fan 78 directed through extension 80 forces air through the opening 74 to form a plurality of bubbles 82.

The wheel 68 has gear teeth arranged around its rim, and the gear teeth of the wheel 68 mesh with the pinon gear 82 driving the fan 78 through the gears 84, 85, 86 and 87 as illustrated in FIG. 2. Additionally, as illustrated in FIG. 2, a conduit 90 which extends from the turbine housing 60 delivers water under pressure to sprinkler head 92.

Figure 4:
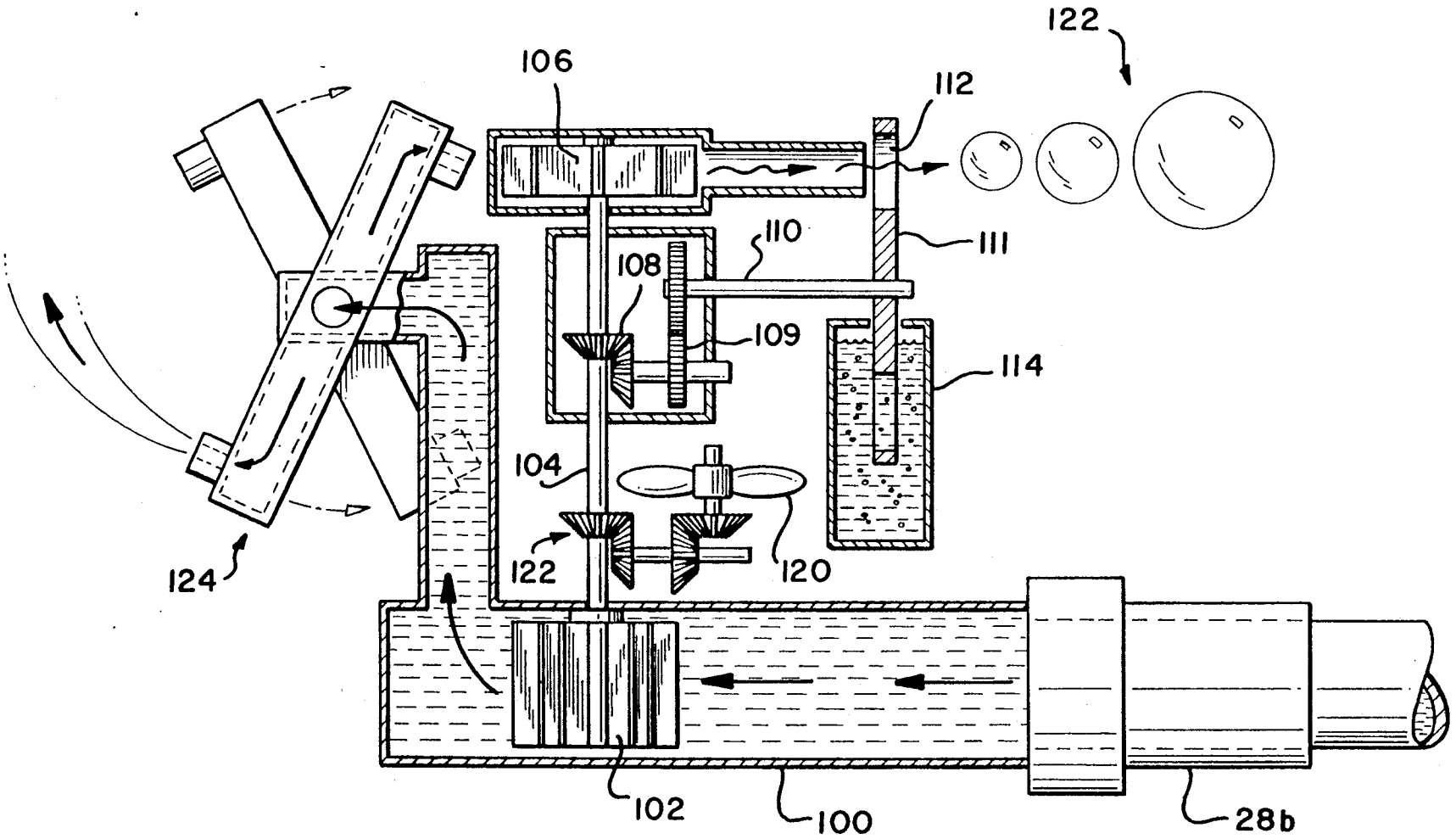
FIG. 4 illustrates schematically another embodiment of the present invention.

In the embodiment illustrated schematically in FIG. 4, the connection **28*b* from the garden hose is connected to a turbine housing 100 containing turbine wheel 102; and shaft 104 of the turbine wheel 102 is extended to provided the drive shaft for the rotary fan 106. As can be seen in the schematic illustration of FIG. 4, gear trains 108 and 109 are provided to rotate shaft 110 of the dipper wheel 111 having circumferently arranged openings 112 which may be rotated sequentially through the container 114 containing bubble solution and into a position receiving forced air from the fan 106. In the embodiment illustrated in FIG. 4, an additional fan 120 receives its motive power through gear train 122 from the turbine wheel 102; and the fan 120 increases the air pressure within the housing 10 to provide a more forceful ejection of the bubbles 122 to drive them from the opening 22 of a housing such as that illustrated in FIG. 1. In a manner comparable to the other embodiments, FIG. 4 includes a sprinkler head 124 which receives water exiting from the turbine housing 120** to provide a rotating sprinkler as will be well understood in the art.

My invention has been described with reference to the schematic illustrations by the drawings, and is not intended to be limited of the details of the above descriptions. My invention is intended to be limited solely by the definitions of the appended claims.

I claim:

1. A device for producing bubbles from water pressure, including a turbine, means for connecting said turbine to a source of pressurized water for rotating said turbine, a fan for forming a flow of air, means for rotating said fan upon rotation of said turbine, a container for a solution capable of forming bubbles, a dipper having at least one opening adapted to be positioned within said container and then withdrawn into the flow of air created by such fan, and means connecting said turbine to said dipper for placing said at least one opening into said container for receiving said solution therewithin and withdrawing said at least one opening into the flow of said air upon rotation of said turbine.

2. A device for producing a spray of water while ejecting bubbles, including a turbine, means for connecting said turbine to a source of pressurized water for rotating said turbine, means including a sprinkler head adapted to be connected to said source of pressurized water for providing a spray of water, and means driven by said turbine for forming a plurality of bubbles when said turbine is rotated.

3. A device according to claim 2, said bubble-forming means including a fan for forming a flow of air, means for rotating said fan upon rotation of said turbine, a container for a solution capable of forming bubbles, a dipper having at least one opening adapted to be positioned within said container and then withdrawn into the flow of air created by said fan, and means connecting said turbine to said dipper for placing said at least one opening into said container for receiving said solution therewithin and withdrawing at least said one opening into the flow of said air upon rotation of said turbine.

4. A device according to claim 3, said dipper including a wheel carrying a plurality of openings arranged circumferently and adapted to be rotated so as to position said openings sequentially into said container and thereafter into said flow of air.

* * * * *